US005638917A

United States Patent [19]

Vennen

[11] Patent Number: 5,638,917

[45] Date of Patent: Jun. 17, 1997

[54] SCAFFOLD BRACKET FOR ROOF STRUCTURE INSTALLATION

[76] Inventor: Dennis L. Vennen, 145 Hekili St., Kailua, Hi. 96734

[21] Appl. No.: 563,023

[22] Filed: Nov. 27, 1995

[51] Int. Cl.[6] ..... E04G 5/06

[52] U.S. Cl. ..... 182/150; 52/633; 52/DIG. 12; 182/113; 182/45

[58] Field of Search ..... 52/DIG. 12, 633; 182/45, 113, 112, 150

[56] References Cited

U.S. PATENT DOCUMENTS

| | | | |
|---|---|---|---|
| 2,332,477 | 10/1943 | Thornley | 182/113 |
| 4,957,185 | 9/1990 | Courchesne et al. | 182/45 X |
| 5,441,125 | 8/1995 | Cook | 52/DIG. 12 X |

OTHER PUBLICATIONS

Pending PR20 Eave Catchguard.

*Primary Examiner*—Wynn E. Wood
*Assistant Examiner*—Timothy B. Kang

[57] ABSTRACT

A work platform system for use while working off the ground in new construction, particularly in installed of roof structures and upper floors where fall protection systems are required and for which no effective work platform systems are available. System consists of frame (10, 12, 14, 16, 18) fabricated from standard galvanized light gauge steel components, with brackets (20, 22), clips (26,28,32) and straps (30) fabricated from standard galvanized stock. Components are welded and/or bolted together, Brackets are attached to partially-completed structure to establish work platform for subsequent construction operation. System utilizes conventional scaffold planks and railings. Installation and use are in accordance with existing regulations for working on work platforms. Use of separate fall protection devices is alleviated by use of this system.

3 Claims, 6 Drawing Sheets

(22)

(20)

(26)

(28)

(32)

(20)

(30)

SCAFFOLD BRACKET FOR ROOF STRUCTURE INSTALLATION

BACKGROUND—FIELD OF INVENTION

This invention is a scaffold bracket for use in conjunction with conventional scaffold planks and railings in performing construction work safely while working one or more stories off the ground.

BACKGROUND—DESCRIPTION OF PRIOR ART

Worker safety while working at heights of greater than 6 feet off the ground has become an increasingly-important aspect of productivity and regulation in the construction industry in recent years. With skyrocketing workers compensation costs, a trend toward excessive litigation and associated awards, both industry and the regulatory agencies have focused on the area of "fall protection" as one extreme importance in construction safety.

Although commercial construction injuries have been most publicized, partly due to their frequently dramatic nature, residential construction has been under increasing scrutiny, and regulations have been tightened to the point of necessitating innovation in the area of worker protection at heights. Recent regulations of the Occupational Safety and Health Administration and the Corps of Engineers are not consistent with each other as regards working at heights. The inconsistent approach of the two agencies has not benefited the industry, and resolution of industry's need to be productive and profitable currently runs headlong against the urgency of regulatory bodies in providing for worker safety at any cost. Essentially, both OSHA and the Corps of Engineers require some means of preventing workers from free-falling for more than six feet while working. Fall protection is not required where there are railings or other positive barriers to falling. Some means of fall protection is required where adequate work platforms with legal railings are not present.

Current systems for fall protection in construction include:

1. Safety belts and lanyards of less than six feet. This system is known to result in massive internal injuries and possible death from the 6 foot fall. The safety belts will be illegal as of 1966.

2. Other fall "arrest" systems. Various harnesses, shock absorbers, etc., are being invented which will allow workers who fall to dangle in the air until they are rescued.

3. Conventional "tube" scaffolding systems. These are work platform systems which are erected from the ground up. These systems restrict work below and around the work platform, involve costly labor and equipment resources, and are frequently inadequate to provide for proper working surfaces. They are sometimes difficult to erect in cases of uneven terrain.

4. "Leading Edge" concept. OSHA has provided some accommodation to the needs of industry to get on with the construction work by effectively conceding that there are certain aspects of the construction process for which there is no current available fall protection system. This work includes rolling of trusses, blocking, facia installation, and some other specified aspects of roof construction. The framing and erection of second floor walls also falls into this category. Current procedures are that the contractor designates particular individuals who, with special orientation and training, are allowed to work unprotected on these specified aspects of the work. Once these portions are completed, the rest of the work must be done with fall protection equipment.

5. Roof-mounted "PR 20 Eave Catchguard." This device is advertised as "Patent Pending" and is designed for roofers to use when installing new roofing materials or replacing roofs on existing structures. This railing system is specifically designed to be attached to roof sheathing which has already been installed, and therefore does not function for the initial erection of roofs or walls. As such, it is not suitable as a device for use in new construction, other than for installation of roofing material. In addition, this bracket does not provide a legal working platform. The construction, attachment, function, and applicability of this product is completely different from the invention proposed in this application, and therefore does not constitute any form of competing product. In fact, the Roof Rail system proposed herein would not function in the place of the Eave Catchguard, since the Roof Rail must be installed prior to roof construction, and the PR 20 cannot be installed prior to roof construction.

OBJECTS AND ADVANTAGES

My purpose in inventing the Roof Rail system, and its various embodiments, was to provide a system for worker safety and productivity for working at heights on some of the most hazardous aspects of the construction process. In particular, the installation of truss, blocking, facia, and roof sheathing and roofing with a proper, safe work platform, rather than having to work precariously or unprotected, from above, was the objective. This invention was necessary, because none of the existing systems provides for full worker safety, and the systems that are available are cumbersome, sometimes dangerous, and are excessively costly. Most of the systems created as many or more hazards than they solved, and concessions were made for the most hazardous of all the operations, the roof work.

The Roof Rail system and its embodiments constitute a new use of existing, available materials to provide for an inexpensive, safe work platform that can be used productively and monitored under existing work platform regulations. It can be used for structures of any height, on any terrain, and can be used by any trades which require access to the upper exterior areas, or which require protection from outside falls. In addition to providing a safe, productive work platform, the Roof Rail system eliminates the need for fall protection devices.

ADVANTAGES OF ROOF RAIL

The Roof Rail system is a work platform, not a fall protection system. As such, it provides the advantage of providing for worker mobility, ease of access to the work, the "peace of mind" that will allow workers to concentrate on the quality and productivity of his work, and there is room around him to lay down his tools, keep spare fasteners or materials, store a water jug, and generally enjoy the same conveniences that he would have if he were working on the ground.

Roof Rail meets all railing and working platform requirements of existing regulations. Workers, safety inspectors, and regulatory agencies already have been trained as to the rules, and no new rules are required for use of the Roof Rail system or its embodiments.

The Roof Rail system provides for safe installation of work that couldn't be done without hazards before. Because a work platform is now available for previously-hazardous operations, apprentices, less experienced workers, and those who were at risk or uneasy with heights will now be able to work on roof truss and related items.

Roof Rail eliminates need for expensive, cumbersome, and sometimes dangerous fall protection devices. In addition, the associated training, use of special consultants, and dealing with worker indoctrination and training, and other unnecessary costs are eliminated.

Rather than adding ropes and other constraints to an already hazardous roofing operation, an efficient, convenient work platform is provided by Roof Rail, which provides for increased productivity and avoid possible injury from tripping or other hazards associated with dangling ropes from fall protection equipment.

Since the Roof Rail is manufactured from inexpensive, available materials using known technology, the cost of the system is relatively inexpensive. The system is also easy to install, providing for a maximum benefit for safety and productivity at a minimum cost Roof Rail solves fall protection and working platform needs of several trades, who would very likely be willing to share the cost of equipment among them, or to reduce their prices accordingly if Roof Rail is provided by the general or prime contractor.

The reduced risk of injury should positively impact the injury rate and commensurate exposure to insurance companies. This should provide eventual relief for workers compensation and liability insurance costs.

Prior to this invention, it was not possible to provide a safe, convenient access to the work for installation of trusses, blocking, facia, and related framing work. Previous attempts have created additional hazards of dangling ropes, possible trip hazards, and where these couldn't be used, concessions have been made to allow "leading edge work." Besides preventing injury or death from falls, the Roof Rail system provides a convenient working platform to facilitate more efficient installation of roof framing. Additional advantages from using this system will become evident as the system becomes integrated into the construction work. For example, since the trade work will now be safer and more convenient, the use of apprentices, helpers, and other less-experienced or disabled workers for roof construction will promote training and help contractors to be more competitive. The industry will benefit locally, nationally, and globally from this invention.

Table I, "Material and Fabrication Specifications" is a listing of each component of the Roof Rail bracket, which includes specifications for the materials of each, the method by which it is attached to other components, and how it is attached to the structure.

| List of reference numberals | |
|---|---|
| 10 | Railing post |
| 12 | Wall post |
| 14 | Joist |
| 16 | Base Piece |
| 18 | Diagonal support |
| 20 | Hanger bracket |
| 22 | Bottom plate |
| 24 | Post cap |
| 26 | Railing clip |
| 28 | Deck clip |
| 30 | Frame strap |
| 32 | Bottom Railing/Deck Clip |

SUMMARY OF INVENTION

The Roof Rail bracket is a light-gauge steel bracket which is hung from and attached to vertical walls. Conventional 2×10 wood scaffold planks and 2×4 wood railings are attached to the brackets, and the resulting system provides a safe, legal work platform for erection of the roof trusses and associated roof framing, roof sheathing, roofing, and other roof-mounted items.

DESCRIPTION OF INVENTION

Figure 1:
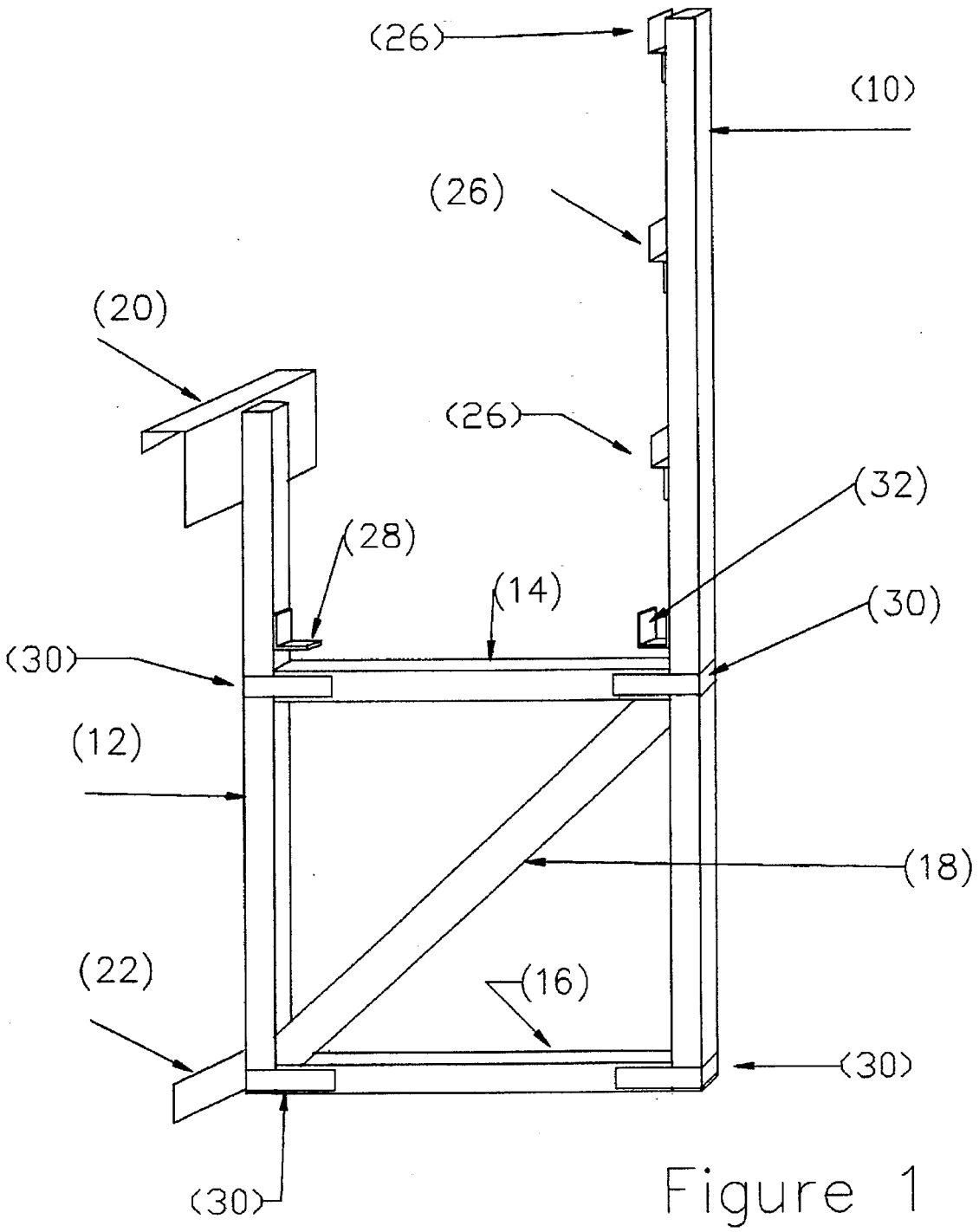
FIG. 1, "Roof Rail" is an isometric drawing of the Roof Rail assembly, with each of the components identified FIG. 2, "Roof Rail for 2'–6" Overhang & 4:12 Pitch Roof with No Gutters" is a side elevation of the Roof Rail in place on a typical roof. The frame size is modified for roofs of other eave widths and roof pitches.
Figure 2:
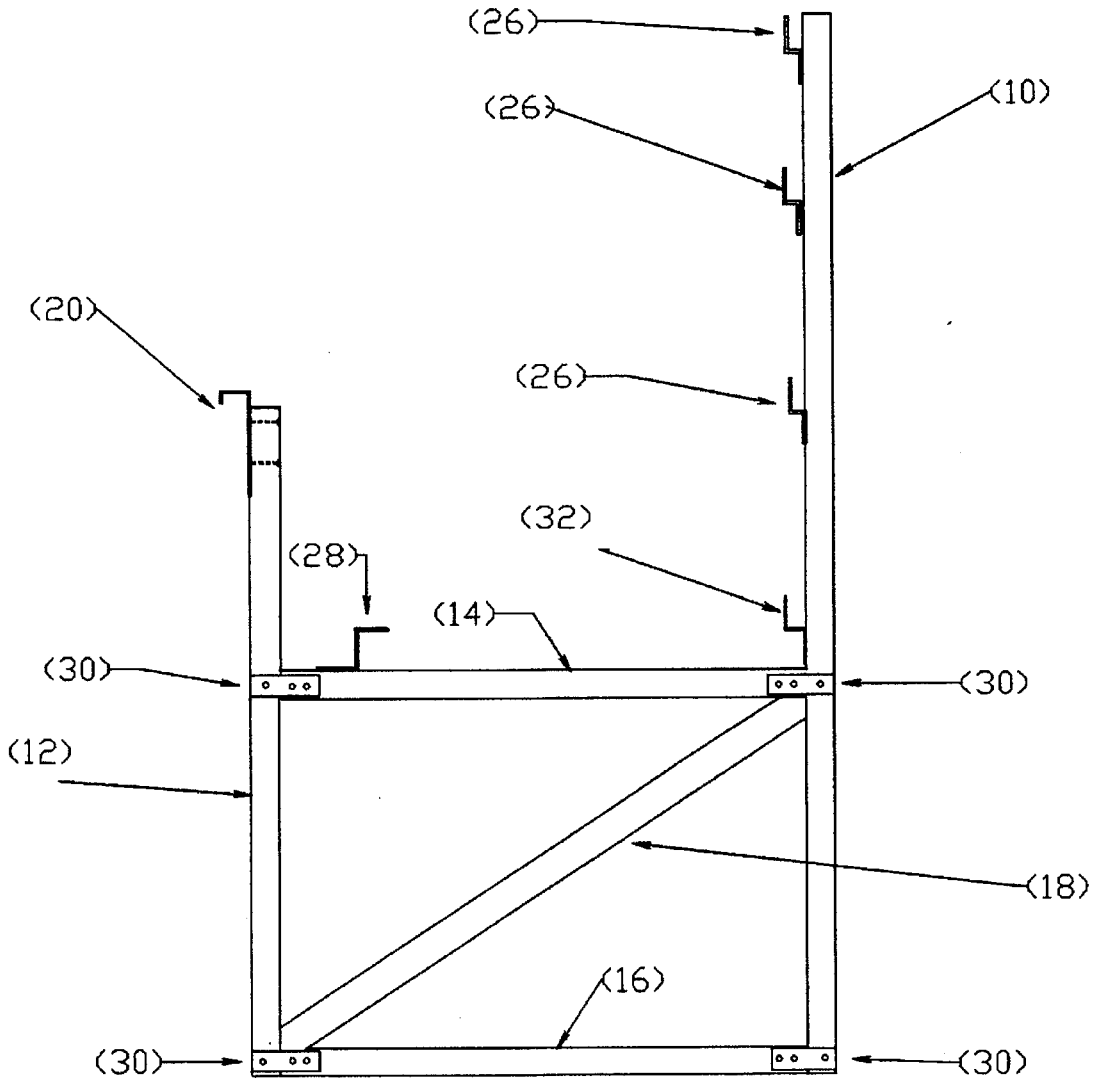
Figure 3:
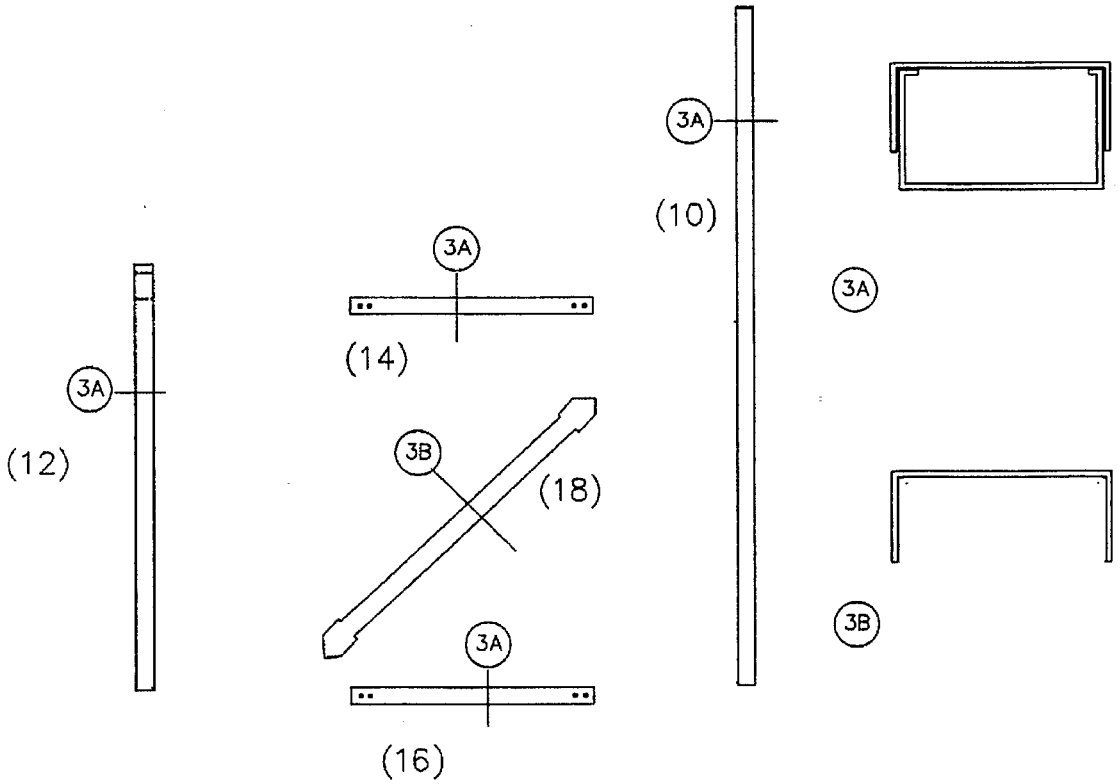
FIG. 3, "Roof Rail Frame member details" shows an exploded view of the frame components, along with sections through the two type of members FIG. 4, "Roof Rail Bracket & Clips" gives pertinent information as to the sizes and materials used for the non-frame members of the Roof Rail assembly.
Figure 4:
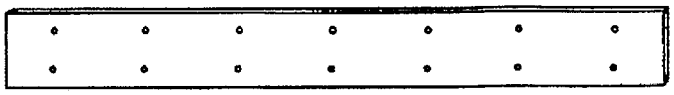
Figure 4:
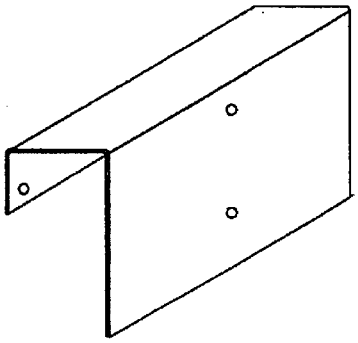
Figure 4:
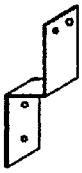
Figure 4:
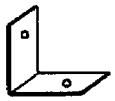
Figure 4:
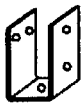
Figure 4:
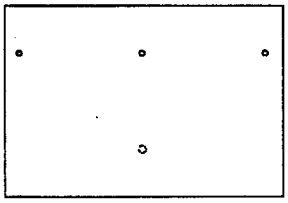
Figure 4:
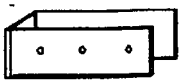

Description of assembly. The Roof Rail assembly is as indicated in FIG. 1. The various frame components, including the railing post (10), wall post (12), joist (14), base piece (16), and diagonal support (18) are all made from standard 16 gauge galvanized light gauge steel shapes. Except for the diagonal support, which is a 2½"×16 gage track with one-inch legs, the balance of the frame components are 2½"×16 gage tracks with one-inch legs nested with 2½"×16 gage light gauge steel studs with 1¼" legs. Section "A" of figure one indicates a section of the frame components. The nested studs and tracks are spotwelded with a minimum of 2" of weld every 24", and the welds are ground and touched up with ZRC cold-galvanizing material to resist corrosion. Section "B" of FIG. 1 indicates the cross-section of the diagonal support member (18).

The other components of the Roof Rail include Frame straps (30), which are used to connect the frame members together, the Hanger bracket (20) and Bottom Plate (22), which are used for attachment to the structure, the post cap, which is a piece of standard, 16 gauge 1½" "carrying channel" with a ¼" leg, and the Railing (26) and Deck (28) clips, which are used to accommodate and secure the conventional wood scaffold planks and 2×4 railings. The conventional scaffold planks and 2×4 railings are not part of this invention.

Railing Post (10). The Railing Post functions partly as an integral past of the structural frame of the Roof Rail, and partly as the vertical railing which is required for a legal work platform under OSHA and Corps of Engineers regulations for personnel use at heights greater than 6 feet off the ground. This piece is connected by welding and bolting to the Joist (14) and Base Piece (16), and has railing clips (26) and a Deck Clip (28) screwed to it to receive the scaffold planks and railings. The railing clips are located to meet the appropriate regulations for toe board, mid-rail, and top rail requirements.

Wall Post (20). The Wall post is also an integral part of the structural frame of the Roof Rail, and in addition, it serves as the attachment point for the Hanger Bracket (20) and Bottom Plate (22), which are used to securely-attach the Roof Rail to the wall of the structure. Like the Railing Post, this member is bolted and welded to the Joist and Base Piece. The brackets mentioned above, along with a deck clip (to secure the conventional scaffold plans) are screwed to this piece.

Joist (14). The Joist also functions as part of the Roof Rail structure, and additionally serves as the support for the scaffold planks on which workers will stand while performing the roof work. The Joist is welded and bolted to the Railing Post and Wall post with the Frame Strap (30). The length of the joist is set to establish the clearance between the completed roof structure and the Railing Post. This clearance must be sufficient to accommodate the required work operations, yet may not exceed the maximum clearances established by OSHA and the Corps of Engineers.

Base Piece (16). The Base piece is also integral to the structure of the Roof Rail, and welded and bolted to the Railing Post and Wall Post in the same manner as is the Joist. The Base Piece length is the same as the Joist.

Diagonal support (18). The Diagonal Support completes the structure of the roof Rail. This member gives diagonal rigidity to the Roof Rail frame, and in particular, provides support for the outer-end of the Roof Rail. The Diagonal Support is fit into place by cutting the legs of the channel, spreading the ends flat, cutting the portion that would overhang the completed frame, and welding the flat ends to the other frame members. After welding, the Frame Straps (30) are installed by welding and bolting. As a result, the Diagonal Support is fully integrated into the Roof Rail structure by welding and bolting to the other members.

Frame Strap (30). The Frame Strap is cut from standard coils of 2"×16 ga. galvanized steel, and cold-rolled to provide a welding surface for connection of the horizontal and vertical frame members of the Roof Rail Bracket. Holes are drilled to facilitate installation of #10×24 tpi (threads per inch) stainless steel machine bolts with lock nuts. Each Frame Strap contains two bolts through the horizontal member and one bolt through the vertical member. In addition to the bolts, the Frame Strap is full-welded to both members where continuous contact is present.

Hanger Bracket (20). The Hanger Bracket is made from 10 ga. galvanized steel, and is sized to fit the particular wall application. The lip of the bracket extends over the double plate and partially-covers the top plate. Three holes are provided in the lip to fasten the bracket to the wall with #10 framing screws. This is to prevent accidental lifting and possible detachment of the Roof Rail bracket from the wall in the event that a forklift or other piece of equipment accidentally strikes the Roof Rail. The Hanger Bracket is attached to the Wall Post with two ¼" stainless steel machine screws, double washers, and nylon-insert lock nuts.

Bottom Plate (22). The Bottom Plate is made from 10 ga. galvanized steel. It is attached to the bottom of the Bottom Plate, and has holes drilled for attachment to the wall at the bottom. This bracket provides additional stability and hold-down of the Bracket.

Railing clip (26). Railing Clips are fabricated from 16 ga. galvanized steel, and are installed on the Railing Post with 2 ea. #10 framing screws. The clips have two holes available for securing of the 2×4 railing members. The Railing Clips may alternatively be installed with 3/16" stainless steel bolts, washers, and nylon-insert lock nut.

Deck Clip (28). Deck Clips are fabricated from 10 gage galvanized steel, and are installed on the Wall Post and Railing Posts with two #10 framing screws to provide a means of securing the conventional scaffold planks to the Roof Rail Bracket. A 3/16 hole is provides for screwing the scaffold plank to the Roof Rail Bracket.

Bottom Railing/Deck Clip. The Bottom Railing/Deck Clip is fabricated from 10 gage galvanized steel, and is installed with a #10×24 tpi stainless steel machine screw with lock nut. It is drilled with holes on the bottom and front flange to secure both the rear conventional scaffold plank and the 2×4 toe board.

Post cap. The Post cap is a cut piece of a standard 16 gage "cold-rolled carrying channel. The piece is cut to approximately 2⅝" to match the width of the Railing- and Wall Posts, and is welded to the top along the two long dimensions. The sides are caulked, and the purpose of the cap is to provide for protection from water intrusion into the inside of the posts.

All welds on the finished Roof Rail Bracket are ground smooth, voids filled with additional weld material, and ZRC cold galvanizing compound is applied to all weld areas and other areas where the original galvanizing was interrupted or damaged. The completed Roof Rail Bracket is painted a distinctive, bright color, but which does not conflict with colors of emergency or warning devices.

ADDITIONAL EMBODIMENT I: CATWALK

An additional embodiment of the Roof Rail is a modification of this bracket for use during the construction of floor and upper-floor wall structures which are high enough off the ground to require work platforms or fall protection systems.

Figure 5:
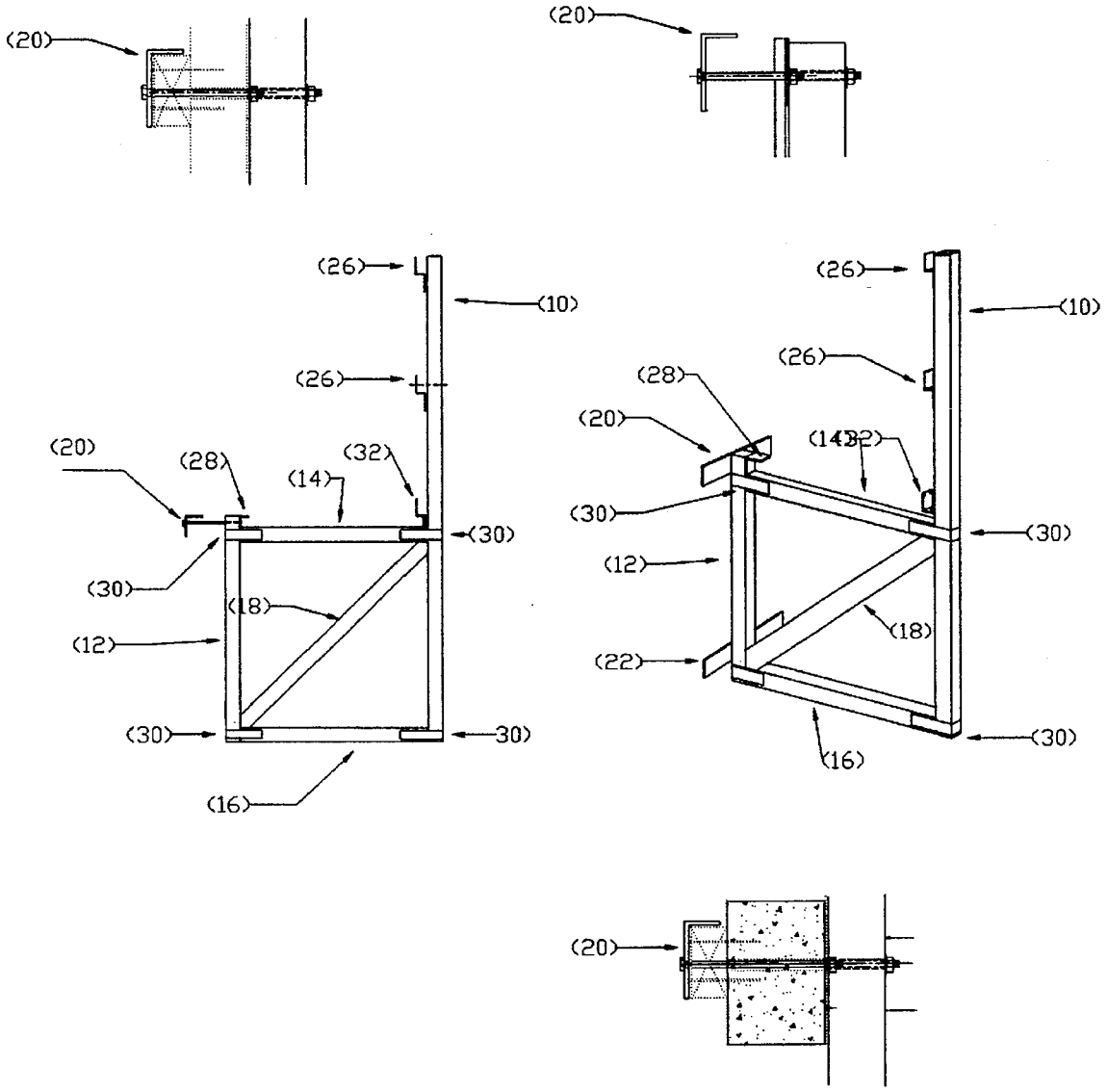
FIG. 5, "Catwalk" provides a description of a modification to the Roof Rail for use in other aspects of construction, along with an isometric view and sections indicating some of the variations of attachment to various structures. The Catwalk is claimed as an embodiment to the Roof Rail invention.

FIG. 5 shows a typical Catwalk. The structure of the Catwalk is the same as the Roof Rail except that the Wall post is shorter, and instead of the Hanger Bracket that the Roof Rail uses, the Catwalk uses a 10 gauge galvanized backup plate, mounted to the inside of the wall, and uses 2¼ "stainless steel screws which are drilled between the top and double plates of the wall structure, and fastened with lock nuts. The deck clip is installed in the reverse of its mounting for the Roof Rail application, because the Wall Post is shorter. The height of the Railing post is arranged to provide the required railing heights for work platform systems.

The catwalk system is intended to be mounted to the completed wall assembly under the same guidelines as is indicated in this application for the Roof Rail system. It functions as a legal work platform for the installation of the floor structure, floor sheathing, framing and erection of second floor walls, exterior wall sheathing, exterior windows, and any other appurtenances which can be installed while standing directly on the work platform. The Catwalk system can also be used for attachment of the Roof Rail brackets to the walls being erected. In particular, the installation of the screws in the Bottom Plate of the Roof Rail Brackets is facilitated by using the Catwalk system.

The Catwalk bracket may also be installed other than at the plate line, by installing a 2×4 flat against at least four vertical studs on the inside of the wall, then extending 2¼" stainless bolts or threaded reds through the wall to the Upper Bracket and securing with flat washer and lock nut. FIG. 5D depicts a typical example of such a condition.

The rules for operation of the Catwalk system are approximately the same as those provided herein for the Roof Rail system.

ADDITIONAL EMBODIMENT II: BACKUP PLATE SYSTEM FOR CATWALK OR ROOF RAIL SYSTEM FOR CONCRETE STRUCTURES.

A second additional embodiment of this invention is the use of a Backup plate system to facilitate using either the Roof Rail or the Catwalk system on concrete structures. A typical Backup Plate application is indicated in FIG. 5E. The Backup Plate consists of two pieces of 10 gauge galvanized steel plate with holes drilled as indicated. ⅜" holes are drilled through the concrete structure, and ¼" stainless steel belts or threaded rods are extended through the wall and fastened to the inside with lock nuts, and with single conventional nut on the outside to hold it in place. The Upper Bracket from the Catwalk or Roof Rail Bracket fits over the protruding threaded rods, and is fastened with flat washer and lock nut on the outside. The balance of the structural and operational aspects of the Roof Rail and Catwalk systems are as otherwise described in this application.

ADDITIONAL EMBODIMENT III: GABLE RAIL

Figure 6:
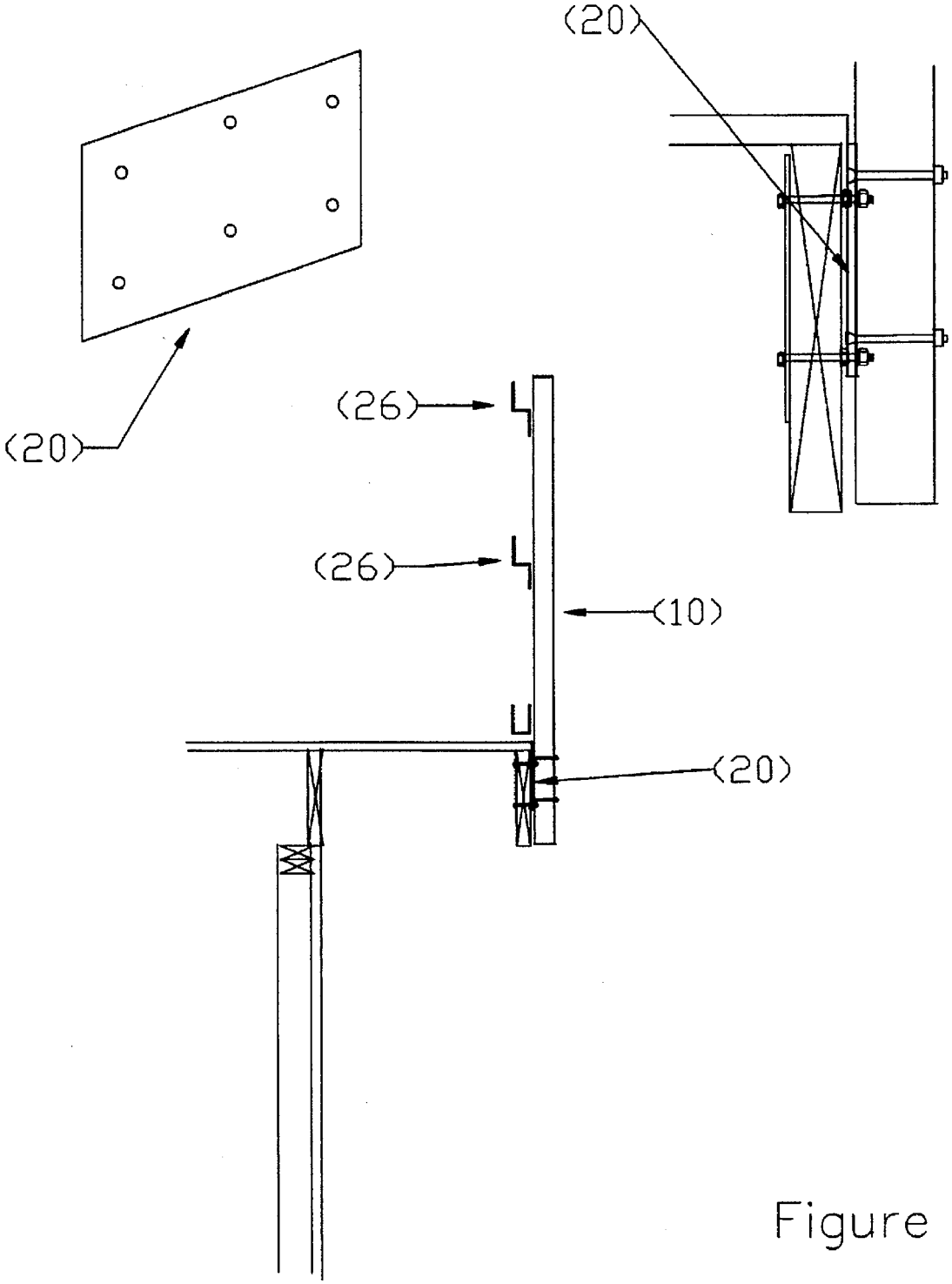
FIG. 6, "Gable Rail" provides a description of an auxiliary assembly which may be used in conjunction with the Roof Rail for rake and gable conditions where sloping of the structure precludes use of the Roof Rail, which must be erected horizontally. The Gable Rail is also claimed as an embodiment to this invention.

A third additional embodiment of this invention is a Gable Rail. This bracket is intended to be used for rake or gable conditions for roof construction where work platform such as the Roof Rail or Catwalk system cannot be used. FIG. 6 shows the Gable Rail details. The construction is the same as the Railing Post, and except for the 10-gage bracket and installation, the structural and operational specifications are the same as for the Roof Rail system.

The Gable Rail functions as a railing only, to preclude the necessity of using any fall protection equipment or procedures during roof construction. Installation of the Gable Rails must be accomplished under existing regulations for railing installation. The Bracket is installed before the barge rafter or other attachment member is erected, so that the installation of the Gable Rail can be done by simply slipping the post over the bracket bolts and securing them with lock nuts.

OPERATION OF ROOF RAIL SYSTEM

Layout and estimating requirements. Roof Rail Brackets must be placed at all corners and at a maximum of 8' on center around the structure. Because each Roof Rail Bracket is constructed for a particular roof overhang and slope, where these differ, two or more types of Roof Rail Brackets may be required. Where changes in overhang occur, brackets are required at each end of the run of each different overhang condition, as well as intermediate brackets at a maximum of 8' on center. Brackets must be centered between trusses, in order to avoid interference of the Hanger Brackets with the securing of the trusses. Where trusses are 24" on center, location of brackets is between every fourth truss. If individual rafters are to be installed, or if the spacing is other than 24" on center, the layout for bracket locations must be adjusted accordingly, but not to exceed 8' on center.

Conventional scaffold planks must be a minimum of 10 feet, to provide the required 1' overhang at each end. For corner conditions, the planks are cantilevered. They must be long enough to meet the overhang requirements, and must not exceed the designed cantilevers for the particular plank. All cantilevered planks must be fully lapped to the corners, to provide for maximum strength of the cantilevered condition.

Railing requirements include four lengths of 2×4 material. Lengths should be a minimum of 16', and joints should be staggered to provide additional strength. Railings should be screwed to each railing bracket, using the hole provided. If 2×4's join other than at brackets, 3½"×20 ga. galvanized steel track a minimum of 24 inches, may be used to cover the joint, with a minimum of 8 ea. #10 plated screws installed vertically in the nested track and railing.

Requirements for existing walls. Walls to which Roof Rail Brackets are to be attached must be of sufficient strength and rigidity so as to meet the minimum design loads and forces of the scaffold system plus the design loads and forces for the structure. As a minimum, such walls must meet the following minimum criteria:

1. The walls are constructed in accordance with Uniform Building Code requirements.
2. All nailing or other fastening must be complete
3. All anchor belts, hold-downs, and other attachments to foundations or lower floor must be in place
4. The entire wall structure, including lateral, return, and interior walls, including double plates, must be completely installed
5. All let-in bracing, shear paneling, and exterior wall sheathing (if required) must be installed
6. There must be a lateral interior wall or equivalent back-brace within 4 feet of each Roof Rail location
7. If there is no wall at the location of a Roof Rail Bracket (e.g., at carport or garage door openings), a temporary wall at least 16" meeting UBC standards, including appropriate fastening at the top and bottom, wide must be installed to receive the Roof Rail Bracket.

Installation—standard configuration. For typical conditions at first floor installation the Roof Rail Brackets are hand-lifted from the outside, and placed at the layout location on the wall. When in the proper position, the Hanger Bracket should be midway between two truss locations, and the holes in the Bottom Plate should line up with studs behind the #10×1½" minimum framing screws are inserted through the 3 holes in the Hanger Bracket, and 4 of the same screws are installed from the outside in the Bottom Plate, using holes that line up with studs in the wall. When the brackets are fully-installed around the structure, conventional scaffold planks are installed and the inner and outer planks are screwed with #10×1" framing screws through the Deck Clips and Bottom Railing/Deck Clips. Finally, the 2×4 railings are installed, also using at least one #10 framing screw at each Railing Clip. Where 2×4s are joined at Railing Clips, at least one screw must be installed in each railing piece.

Installation—Corner conditions. Roof Rail Brackets must be installed between each hip or valley rafter and the adjacent jack rafter, to minimize the cantilevering of scaffold planks. After installation of the Roof Rail Brackets, conventional scaffold planks must be completely lapped, so that the cantilevered conditions are double-planked. Railings are then installed, and nailed together where they intersect or bypass.

Installation—End conditions. Where a length of Roof Rail terminates, such as at a gable condition, the scaffold planking and railings must be closed off. This is done be nailing 2×4s to the existing railings and to the wall or structure. ⅜" cable may be used, with attachments to the structure which comply with OSHA standards. Other methods of fall prevention or protection must be provided where eave conditions not covered by the Roof Rail system are not present.

Installation of conventional scaffold planks. Conventional microlam or other approved scaffold planks are installed on the Roof Rail Brackets by slipping them under the Deck or Bottom Railing/Deck Clips so as to overhang each Bracket by approximately 1foot. Planking should be done from left to right, or right to left, so that each new set of planks laps over those installed immediately preceding them. Screws must be installed as the planks are installed, as the clips are not accessible, once the subsequent set of planks is installed.

Installation of railings. Installation of railings must be done in accordance with approved OSHA or Corps of Engineers procedures. 2×4s should be approximately 16' and arranged so that the joints are staggered. Screws should be installed as the railings are placed, so that they can't be knocked out of the clips during installation of subsequent railings. At corner conditions, one railing may bypass the intersecting railings, except in cases, such as inside corner conditions, where this could interfere with the work. Bypassing ends at outside corner conditions should not exceed 2 feet. All intersecting railings should be nailed in accordance with UBC nailing for intersecting studs.

Inspection prior to use. The designated project safety representative or project superintendent should personally inspect the installation of each Roof Rail system prior to its being put into use.

Access to work platform. Access to Roof Rail work platform systems should be in accordance with OSHA or Corps of Engineers access requirements.

Using Roof Rail work platform. Once installed, the Roof Rail work platform system is used the same way as any work platform system. Any modifications which may be required during the course of construction should be done only by persons designated by the project superintendent. Each modification should be inspected by the project superintendent or safety officer prior to use. All persons using the Roof Rail work platform system must comply with all OSHA and/or Corps of Engineers safety requirements for working on elevated platforms.

Disassembly and removal. Removal of the Roof Rail work platform system is done essentially in the reverse order in which the system was erected. Accesses are first removed or flagged as being out of service. Railings and railing attachments to the structure are removed first, followed by scaffold planks. Roof Rail Brackets must be removed from the outside by lifting the brackets by hand or by fork lift vertically approximately 2½", then moving about 4" back from the wall, to allow the inside lip of the Hanger Bracket to clear the wall without damaging the underside of the eaves of the structure. The bracket is then lowered to the ground for removal or relocation. If the bracket is to be moved to another location, it must be inspected and documented by an authorized manufacturer's representative prior to reinstallation at the next location.

Advantages of Roof Rail System

Work platform vs. fall protection system. The invention of the Roof Rail Bracket is a significant breakthrough for the construction industry. Until this invention, contractors, workers and their representatives, and safety enforcement officials have had to consider the alternatives of sacrificing productivity or safety of the workers in establishing mutually agreeable procedures for construction work at heights. Fall protection devices, systems, and procedures previously utilized have been counterproductive, expensive, and frequently unsafe. In particular, the installation of roof trusses and appurtenances in residential construction have been the subject of heated debate and both industry and regulatory bodies have had to make sacrifices in order to facilitate the continuation of construction projects. In short, no one has been satisfied with other procedures. The Roof Rail work platform system eliminates need for fall protection devices or procedures, and at the same time, provides a safe, productive work platform for the workers. It is particularly oriented toward the most exposed of the tasks, the roof structure.

No new rules required. Since the Roof Rail system constitutes a work platform, the installation and use of the system can be monitored without the issuance of modifications to existing safety regulations and procedures. Therefore, workers, safety officers and supervisors, as well as regulatory agencies, may use the knowledge and experience of using existing regulations to monitor and control work operations. The only new aspect is the Roof Rail Bracket and the attendant operational requirements as described above.

Mobility. By providing a work platform for the roofing work, the workers will have better mobility during roof construction. The work platform is approximately two feet below the plate line, so that the installation of trusses, blocking, facia, and other framing members will require less bending, stooping, and precarious footing. This will help reduce fatigue, strains, and other injuries, and will permit the workers to concentrate on the quality and productivity of their work, rather than being preoccupied with maintaining their balance and footing.

Fewer physical barriers to workers. In the framing trade, many workers are denied the opportunity to do work on roofs because of their uneasiness with working at heights, their lack of physical dexterity or flexibility, or sometimes because they have colds or are on medication which could affect their equilibrium. With a safe working platform, these persons, as well as apprentices and other less-experienced workers, will be able to work on these critical aspects of the construction process.

Better productivity. Productivity should be markedly improved for roof structure work, once the workers begin taking advantage of having a proper work platform for roof construction. By not having dangerous, restricting ropes hanging from their waists or backs, having the freedom to move around without feeling as if they are walking a tightrope, having room to stack blocking materials, additional fasteners, places to lay down their saws, keep water jugs, etc., much of the work that previously required assistance from below will be able to be done by a single person.

Inexpensive. Contractors will find that the Roof Rail Brackets are substantially less costly than using conventional fall protection systems or tube scaffolding systems in out-of-pocket costs, labor required to install and remove the system, and in the productivity of their work.

Safer. The most important aspect of the Roof Rail system is that it is far safer than any other available system for erecting roof structures.

Conclusion, ramifications, and scope of invention

As is evidenced by the above description of the Roof Rail, Catwalk, Gable Rail, and other specified embodiments, the Roof Rail system stands to provide for worker safety, company productivity, and regulatory efficiency in the construction industry. This new invention will greatly enhance the construction process, and will work to the benefit of the entire industry.

Although the description of the Roof Rail and embodied system components contain a number of specifics, their itemization should not be construed as limitations as to the scope of the invention, but rather as examples of certain applications of the invention. Numerous other applications and modifications are possible without departing from the basic idea of the invention in addition those indicated.

As examples:

1. The use of nested conventional galvanized light gauge tracks and studs is a typical material that can be used.

For larger work surfaces, larger sized or heavier gauge studs and tracks could be used, or manufactured square, rectangular, or round tubes could be substituted.

2. Conventional eye bolts could be substituted for the Railing Clips, and ⅜" wire railings could be substituted.

3. Different attachment brackets or backup plates, or larger bolts and/or threaded rods could be substituted to achieve heavier work platform ratings for specialized applications.

4. An extension post could extend down from the Railing Post to the ground below, with a base plate attached to the ground, in lieu of constructing a temporary wall at openings where there is no wall to receive the Bottom Plate of the bracket to.

5. Threaded or partially-threaded rods could extend horizontally inside the Joist and Base Piece and be bolted at the rear of the Railing Post, to provide for additional strength of the system for special applications Accordingly, the scope of the invention should be determined not by the itemized embodiments, but by the appended claims and their legal equivalents.

I claim:

1. A platform for temporary attachment to a structure comprising top, inside and outside faces, said platform comprising:

at least two support devices for attachment to said top, inside and outside faces of said structure;

a plurality of planks for providing a walkway; and a plurality of horizontal railing members;

said support devices each comprising:

an elongate upright member;

said elongate upright member having an upper and lower end;

the upper end of said elongate upright member having pre-drilled holes;

an attachment bracket at the upper end of said elongate upright member;

said attachment bracket having pre-drilled holes for alignment with said holes in the upper end of said elongate upright member;

fastening means for fastening said attachment bracket to said elongate upright member, an upper elongate horizontal support projecting outwardly from a point between the upper and lower

TABLE I

Roof Rail
Material and Fabrication Specifications
Dennis L. Vennen, Inventor

| Item | Material | Attachment to other rail parts | Other attachment methods |
|---|---|---|---|
| Railing post | 2 ½" × 16 ga. galvanized steel track with 1" leg nested with 2 ½" × 16 ga. galvanized steel stud with 1 ¼" leg, spotwelded at seams with minimum of 2" weld at 24" o.c. Spotwelds to be ground smooth and brush-coated with ZRC cold-galvanizing compound | | |
| Wall post | Same as railing post | | |
| Joist | Same as railing post | Frame strap full-welded, plus 2-#10 × 24 stainless machine bolts with lock nuts at joist, and 1 #10 × 24 stainless machine bolt with lock nut at railing post. | |
| Base piece | Same as railing post | Same as joist | |
| Diagonal support | 2 ½" × 16 ga. galvanized steel track with 1" leg, leg cup and spread at ends for attachment to frame | Full-selded to post, joist, and base piece prior to installation of frame strap | |
| Hanger bracket | 10 ga. galvanized steel, cold-rolled to specified shape for wall thickness plus ¼" | 2 ¼ × 24 Stainless steel bolts with lock nuts and washers at head and nut | 3 3/16" holes on inside flange to facilitate installing #10 framing screws in wall plate |
| Bottom plate | 10 ga.. galvanized steel, sheared to shape | 2-#10 zinc-plated self-tapping light-gauge steel framing screws | 4 3/16" holes to line up with studs behind wall sheathing, for installation of #10 framing screws |
| Frame strap | 2" × 16 ga. galvanized steel flat stock, cold-rolled | Full-welded to joint or base piece, sides welded to post, plust bolts per joist or base-piece installation specs. | |
| Deck clip | 10 ga. galvanized steel angle, cold-rolled | 2-#10 zinc-plated self-tapping light-gauge steel framing screws | 3/16" hold for installing #10 framing screw to secure planks |
| Railing clip | 10 ga. galvanized steel, cold-rolled | Same as deck clip | 2 3/16" holes to facilitate installation of #10 framing screws to 2 × 4 railing pieces |
| Post cap | 16 ga. galvanized standard 1 ½" cold-rolled carrying channel | Full-welded in long dimenstions, caulked at edges for moisture seal. | |

ends of said elongate upright member for supporting said planks thereon;

a lower elongate horizontal support projecting outwardly from the lower end of said elongate upright member;

an elongate vertical member, said elongate vertical member having a lowe end, middle, and upper end;

said upper elongate horizontal support intersecting said elongate vertical member at said middle of said elongate vertical member, thereby forming an intersection;

said upper end of said elongate vertical member extending vertically from the middle to provide a structure and support for said horizontal railing members;

fabricated clips attached to the upper end of said elongate vertical member for receiving said horizontal railing members;

an elongate diagonal member extending from the lower end of said elongate upright member to the outward end of said upper elongate horizontal support, away from said elongate vertical member;

said elongate upright member, said upper and lower horizontal support members, said elongate vertical member, and said elongate diagonal member, attached together, to form a structural truss;

reinforcing straps, affixed horizontally to said intersection of said upper and lower elongate horizontal members to said elongate upright and vertical members.

2. A platform as claimed in claim 1, wherein:

said elongate upright member extending a short distance above the upper elongate horizontal support;

a flat plate affixed laterally to the upper end of the elongate upright member said flat plate having holes predrilled for insertion of said fastening means;

an angular plate capable of being affixed to the inside face of the structure said angular plate having holes which are capable of aligning with said holes in said flat plate to receive said fastening means.

3. A platform as claimed in claim 1, wherein;

said elongate vertical member having affixed thereon fabricated clips for receiving railing posts;

said elongate vertical member having holes pre-drilled for insertion of fastening means in order to affix said elongate vertical member to the outside face of said structure.

* * * * *